US011395955B2

(12) United States Patent
Kumar

(10) Patent No.: US 11,395,955 B2
(45) Date of Patent: Jul. 26, 2022

(54) BOARD GAME AND METHOD FOR PLAYING

(71) Applicant: Devakumaran J. Kumar, Janesville, WI (US)

(72) Inventor: Devakumaran J. Kumar, Janesville, WI (US)

( * ) Notice: Subject to any disclaimer, the term of this patent is extended or adjusted under 35 U.S.C. 154(b) by 0 days.

(21) Appl. No.: 16/205,932

(22) Filed: Nov. 30, 2018

(65) Prior Publication Data

US 2020/0171376 A1 Jun. 4, 2020

(51) Int. Cl.
*A63F 3/02* (2006.01)
*A63F 3/00* (2006.01)

(52) U.S. Cl.
CPC ..... *A63F 3/02* (2013.01); *A63F 3/00697* (2013.01); *A63F 2003/00703* (2013.01)

(58) Field of Classification Search
CPC ..... A63F 3/02
USPC ..... 273/260–261
See application file for complete search history.

(56) References Cited

U.S. PATENT DOCUMENTS 186,181 A * 1/1877 Underwood ..... A63F 3/02 273/260
1,373,448 A * 4/1921 Precinauskas ..... A63F 3/00176 273/261
1,658,503 A * 2/1928 Vincent ..... A63F 3/02 273/260
2,379,465 A * 7/1945 Vollmer ..... A63F 3/00697 273/284
3,811,679 A * 5/1974 Benge ..... A63F 3/00075 273/258
5,772,207 A * 6/1998 Caseila ..... A63F 3/02 273/260
6,196,545 B1 * 3/2001 Peeples ..... A63F 3/02 273/258
2001/0011798 A1 * 8/2001 Anderson ..... A63F 3/02 273/258
2006/0017226 A1 * 1/2006 Yamazaki ..... A63F 3/02 273/236

FOREIGN PATENT DOCUMENTS

CH 433081 A * 3/1967 ..... A63F 3/02

OTHER PUBLICATIONS

"Standard Checkers Rules", King Me(TM) Checkers, Winning Moves, Inc., 2008 (Year: 2008).*

(Continued)

*Primary Examiner* — Laura Davison
(74) *Attorney, Agent, or Firm* — Brett J. Trout

(57) ABSTRACT

A board game is provided having a seven-by-seven play area and ten player tokens for each player. Each player's tokens are positioned on the play area in two rows of five along opposing sides of the play area. Players alternate turns, taking up to five orthogonal movements from one playing space to another on each turn, the five movements being allocated across up to five of the player's player tokens. When a player token is orthogonally surrounded on at least three sides by opposing player tokens, that player token is removed from the play area. Play continues until one player has only two player tokens remaining on the play area, at which time the opposing player is declared the winner.

2 Claims, 10 Drawing Sheets

(56) References Cited

OTHER PUBLICATIONS

"Destroy the Invaders", published by 2000 AD Comics, 1981, as described atwww.boardgamegeek.com/boardgame/120256/destroy-invaders (Year: 1981).*
Dvukhodovie Shashki, "Double-Move Checkers", dvhahoda.ru/pravila, archived by the Internet Archive on Apr. 15, 2012; English machine translation (Year: 2012).*
'Hasami shogi', en.wikipedia.org/wiki/Hasami-shogi, captured May 31, 2017 (Year: 2017).*
'Tafl games', en.wikipedia.org/wiki/Tafl_games, captured Mar. 9, 2016 (Year: 2016).*
"Lords and Vassals" by Rey Alicea, (C) 2012, described on www.boardgamegeek.com/boardgame/133509/lords-and-vassals, archived Jun. 4, 2014 (Year: 2014).*
"Cambodian Chess Games", history.chess.free.fr/Cambodian%20Chess%20Games.htm, archived Aug. 11, 2004 (Year: 2004).*
"Egyptian Siga", mlwi.magix.net/bg/Egyptian_Siga.htm, archived Mar. 15, 2016 (Year: 2016).*
'Ludus latrunculorum', en/wikipedia.org/wiki/Ludus_latrunculorum, archived Jun. 13, 2016 (Year: 2016).*
English machine translation of CH 433,081 A (Year: 1967).*
Ultima Architects "Hasami shogi" gameplay, as demonstrated in the YouTube video "Hasami shogi gameplay" posted by Godless Gaming 216 on Dec. 16, 2016, www.youtube.com/watch?v=w4m7dqmhCXo (Year: 2016).*
"Destroy the Invaders," published by 2000 AD Comics, PROG 233, Oct. 10, 1981.

* cited by examiner

BOARD GAME AND METHOD FOR PLAYING

TECHNICAL FIELD

The disclosed embodiments relate generally to a board game and, in particular, to a board game played by multiple people using strategy to move their respective tokens to surround and eliminate the tokens of opposing players.

BACKGROUND

Board games have been known in the art for centuries. At present, there are over one hundred thousand board games in existence. Board games range from pure luck games to pure strategy games. One drawback of prior art games is that they employ too much luck for experienced players or too much strategy for new players. It would be desirable to provide a board game with sufficient strategy to engage experienced players, while maintaining a level of strategy accessible and practicable for newer players.

Prior art board games run the gamut from games with only a few pieces to games with over one thousand pieces. The rules for these games run from simple to complex and the time it takes to play them can range from a few minutes to many hours. Some of the more complex games can take several hours simply to set up. It would be desirable to provide a board game that is easy to learn and easy to set up with a small number of pieces, while still providing an enjoyable playing experience.

Another drawback associated with prior art board games is the lack of player interaction. Some board games involve a very low amount of player interaction and result in more of a solitaire experience than a group experience. It would be desirable to provide a board game with a high degree of player interaction.

While board game enthusiasts may prefer deeper, more strategy-based board games, these types of game can be off-putting for more casual gamers. It would be desirable, therefore, to provide a strategy-based board game that is easy for new players to learn, while still providing a depth of complexity to satisfy more seasoned players.

SUMMARY OF THE DISCLOSED SUBJECT MATTER

To overcome the limitations in the prior art described above, and to overcome other limitations that will become apparent upon reading and understanding the present specification, the present application discloses an implementation of a novel board game and method of playing. A playing board defines a play area having a seven by seven grid of forty-nine playing spaces. Each player has ten player tokens positioned on the play area in two rows of five along opposing sides of the play area. The players alternate turns, taking up to five orthogonal movements from one playing space to another, allocated across up to five of the player's player tokens. When a player token is orthogonally surrounded on at least three sides by opposing player tokens that player token is removed from the play area. Play continues until one player has only two player tokens remaining on the play area at which time the opposing player is declared the winner.

Other implementations of the board game are disclosed, including implementations directed to different player counts and board layouts.

BRIEF DESCRIPTION OF THE DRAWINGS

The present invention will now be described, by way of example, with reference to the accompanying drawings in which.

DETAILED DESCRIPTION OF THE DRAWINGS

The board game of the present invention has a gridded play area along which players move tokens. The players alternate turns, moving their tokens a number of orthogonal movements from one playing space to another, allocating the movements across one or more of the player's tokens. When a player's token is orthogonally surrounded on at least three sides by opposing player tokens that player's token is removed from the play area. Play continues until one player has lost a predetermined number of tokens from the play area at which time the opposing player is declared the winner.

Figure 1:
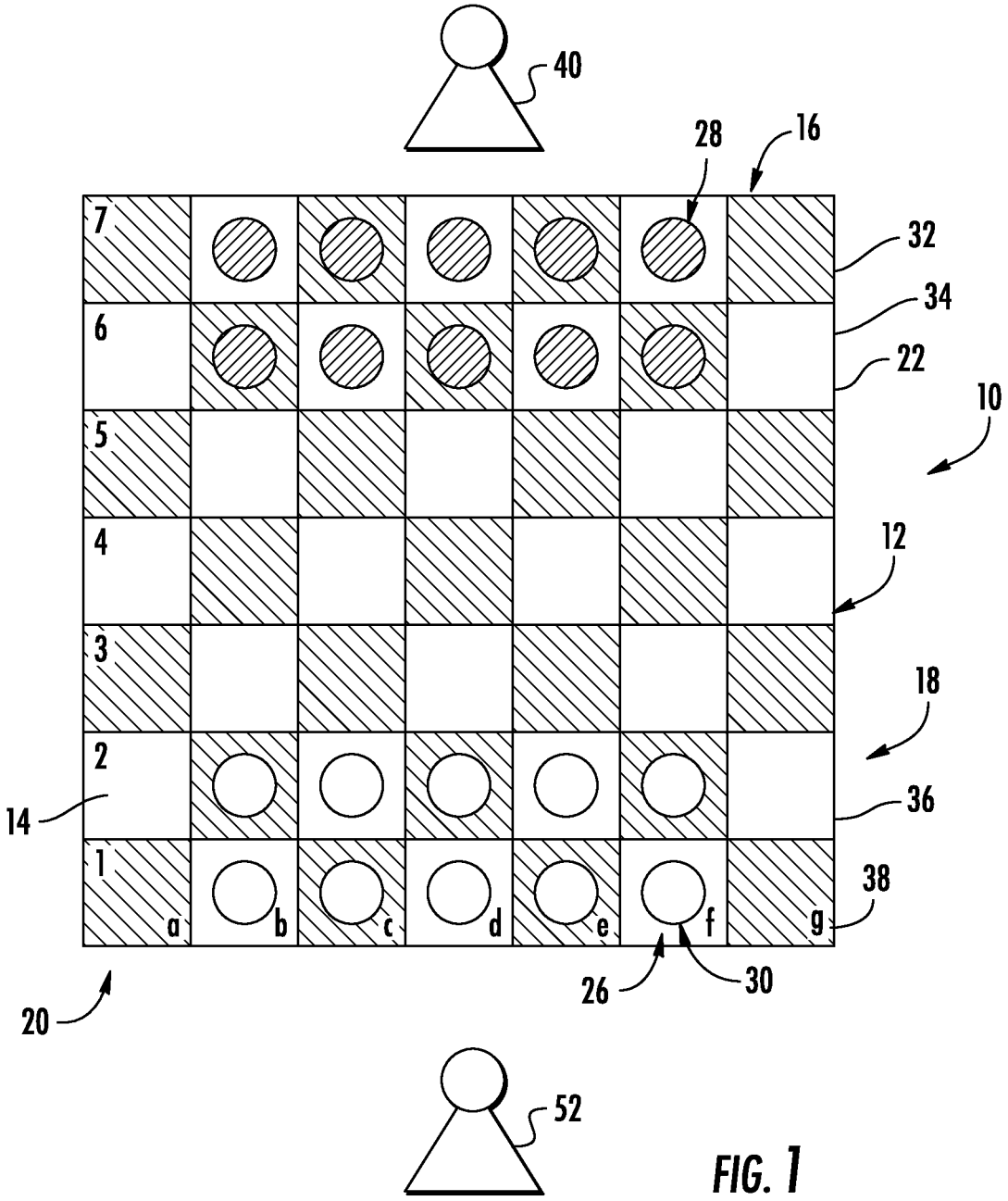
FIG. 1 illustrates a top elevation of a board game having a game board with player tokens in a starting position in accordance with one embodiment.

A board game of the present invention is shown generally as (10) in FIG. 1. The board game (10) has a gridded playing board (12) having a plurality of playing spaces (14), such as the quadrangles shown in FIG. 1, arranged on a grid (16). While the grid (16) can have any desired number of playing spaces (14), the grid (16) preferably has at between nine and two hundred and twenty-five playing spaces (14), more preferably between twenty-five and one hundred and fortyfour playing spaces (14), and most preferably forty-nine playing spaces (14) arranged in seven rows (18) and seven columns (20). While the playing spaces (14) are preferably square, they may be triangular, pentagonal, hexagonal, or any desired shape. While the grid (16) is preferably square, the grid (16) may be an oblong rectangle, a triangle, or any other desired configuration, with any desired arrangement of playing spaces (14). While in the preferred embodiment, there are no areas within the perimeter (22) of the grid (16) that are not playing spaces, the grid may be provided with any desired number of non-playing spaces, which may have wording on them designating them as non-playable spaces or they may be merely provided with a different color or configuration to designate them as non-playable spaces. Preferably all playing spaces (14) not on the perimeter (22) of the grid (16) are touching contiguous playing spaces (14) on all sides, any playing space (14) may be arranged and configured to not be contiguous with other playing spaces (14) on one or more sides.

Figure 2:
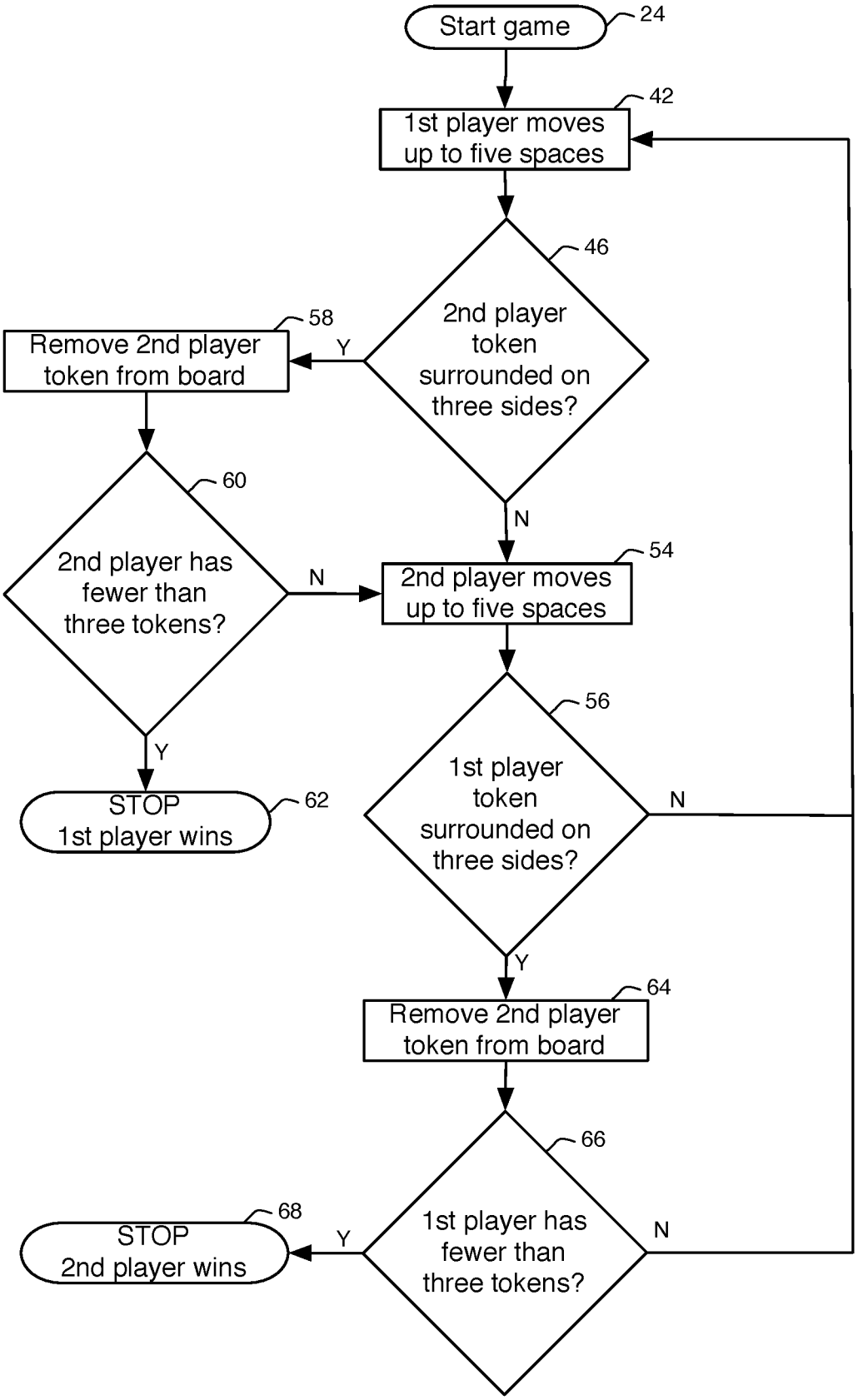
FIG. 2 illustrates a schematic flow chart illustrating a method of playing the board game in accordance with one embodiment.

In a preferred embodiment shown in FIGS. 1-2, to start (24) the game, a plurality of player tokens (26) are positioned on the grid (16). While any desired number of player tokens (26) may be used, preferably there are ten first player tokens (28) and ten second player tokens (30). Five first player tokens (28) are centered on the first row (32) of the grid (16) and five first player tokens (28) are centered on the second row (34) of the grid (16). Similarly, five second player tokens (30) are centered on the sixth row (36) of the grid (16) and five second player tokens (30) are centered on the seventh row (38) of the grid (16).

Once the player tokens (26) have been arranged on the grid (16) as shown in FIG. 1, a first player (40) moves (42) one or more of the first player tokens (28) up to five playing spaces (14), moving the one or more of the first player tokens (28) from one playing space (14) to another playing space (14) that is edge-adjacent. The first player (40) may move (42) five of the first player tokens (28) one playing space (14) each, one of the first player tokens (28) five playing spaces (14), or may allocate the five movements across any combination of the first player tokens (28). For instance, the first player (40) could move (42) one first player token (28) four playing spaces (14) and another first player token (28) one playing space (14). Similarly, the first player (40) could move less than a total of five playing spaces (14) by moving one first player token (28) two playing spaces (14) and another first player token (28) two playing spaces (14). The first player (40) could not, however, move one first player token (28) four playing spaces (14) and another first player token (28) two playing spaces (14).

Figure 3:
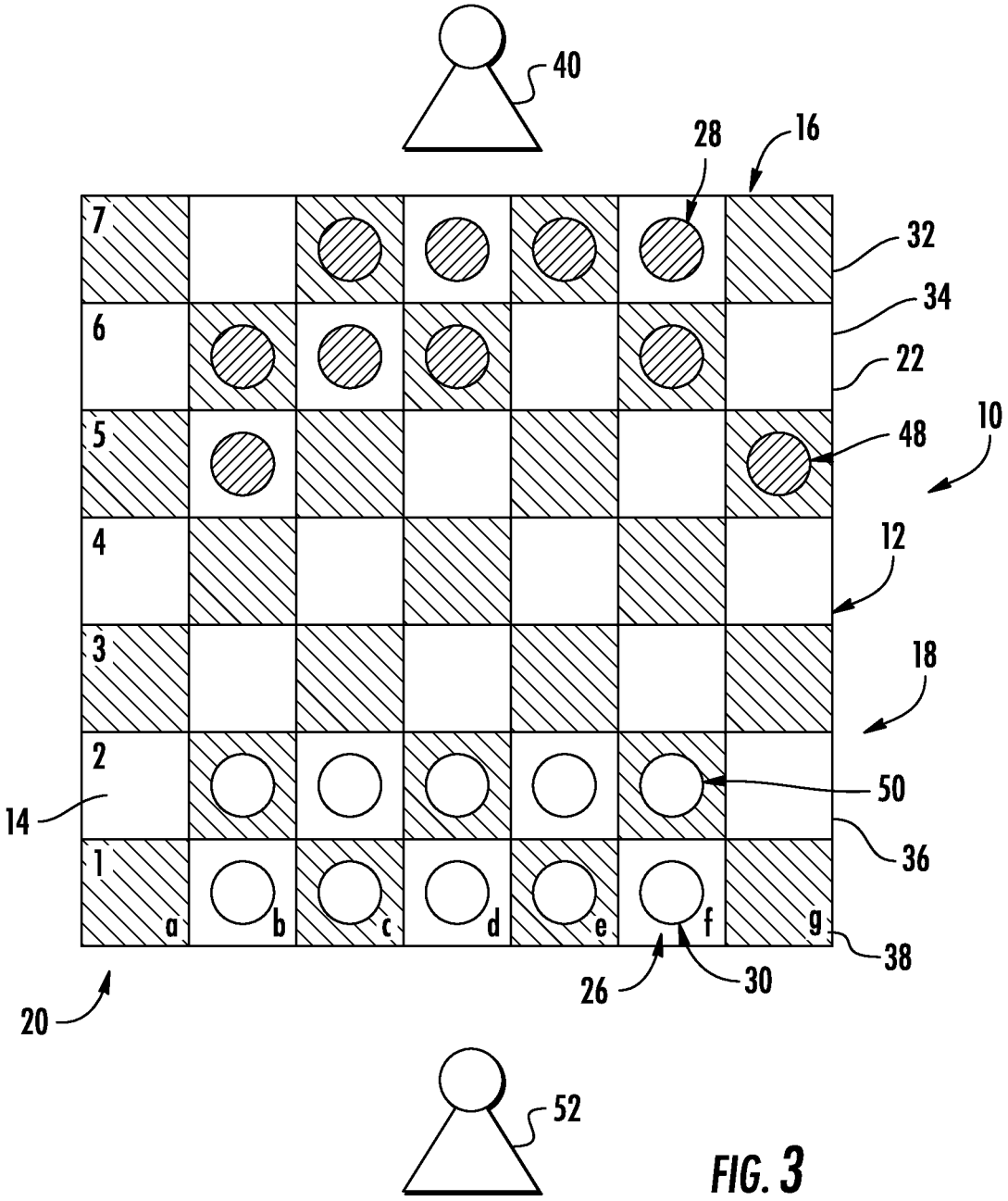
FIG. 3 illustrates the board game of FIG. 1, with player tokens in a resulting position after a first player's turn in accordance with one embodiment.

The first player (40) may only move the first player tokens (28) from one playing space (14) to another playing space (14) if the two playing spaces (14) are edge-adjacent to one another. This means that in a gridded playing board 12, such as shown in FIG. 3, the first player (40) may only move the first player tokens (28) orthogonally from one playing space (14) to another. In other words, the first player (40) may not move the first player tokens (28) diagonally from one playing space (14) to another. While the first player (40) preferably moves a total of five playing spaces (14), the board game (10) may alternatively be played with the players (40 and 52) taking turns moving any predetermined number of total playing spaces (14) from one to ten. Similarly, the board game (10) may be played with the first player (40) being restricted to moving a lower predetermined numbers of playing spaces (14) on the first turn to compensate for the moving first. Alternatively the players (40 and 52) may take turns moving variable numbers of playing spaces (14), with the variable number being determined by such factors as the amount of playing time that has elapsed, disproportionate player skills, the number of player tokens (26) a player (40 or 52) has remaining on the grid (16), or any desired algorithm.

Figure 5:
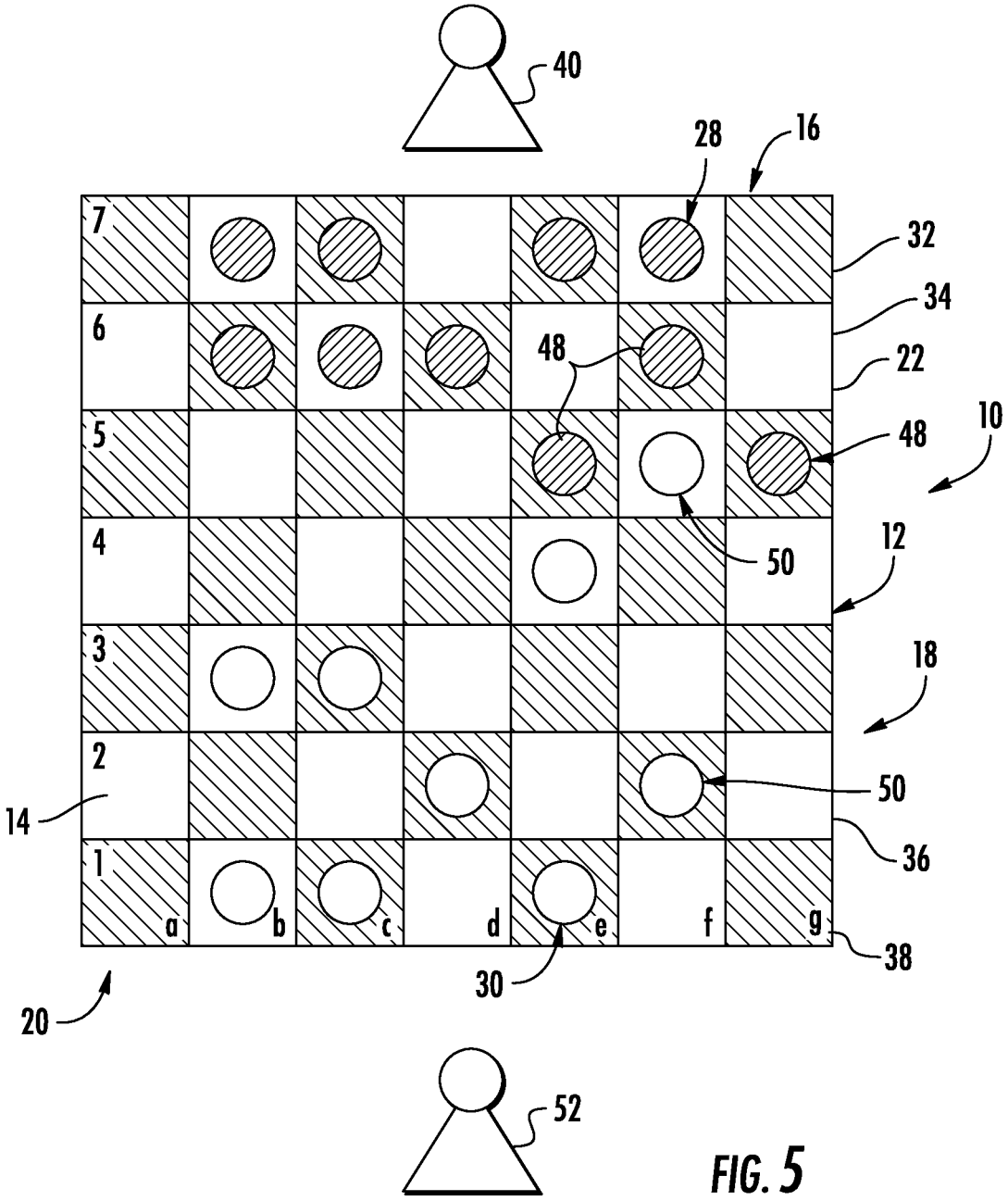
FIG. 5 illustrates the board game of FIG. 5, after multiple turns, with player tokens in a resulting position after a first player's player tokens have surrounded the second player's player token on three sides in accordance with one embodiment.

As shown in FIG. 3, the first player (40) moved two first player tokens (28) one playing spaces (14) each and one first player token (28) three playing spaces (14). The players (40 and 52) then determine if the first player's movements result (46) in at least three of the first player tokens (28), defined during the duration of the first player's turn as the attacking tokens (48), being located on at least three different playing spaces (14) edge-adjacent, in this embodiment orthogonal, to a playing space (14) occupied by a second player token (30), defined during the duration of the first player's turn as the defending tokens (50). FIGS. 2-3, and 5. If, as shown in FIG. 3, the first player's movements do not result (46) in at least three of the first player tokens (28) being orthogonal to a second player token (30), play moves to the second player (52).

Figure 4:
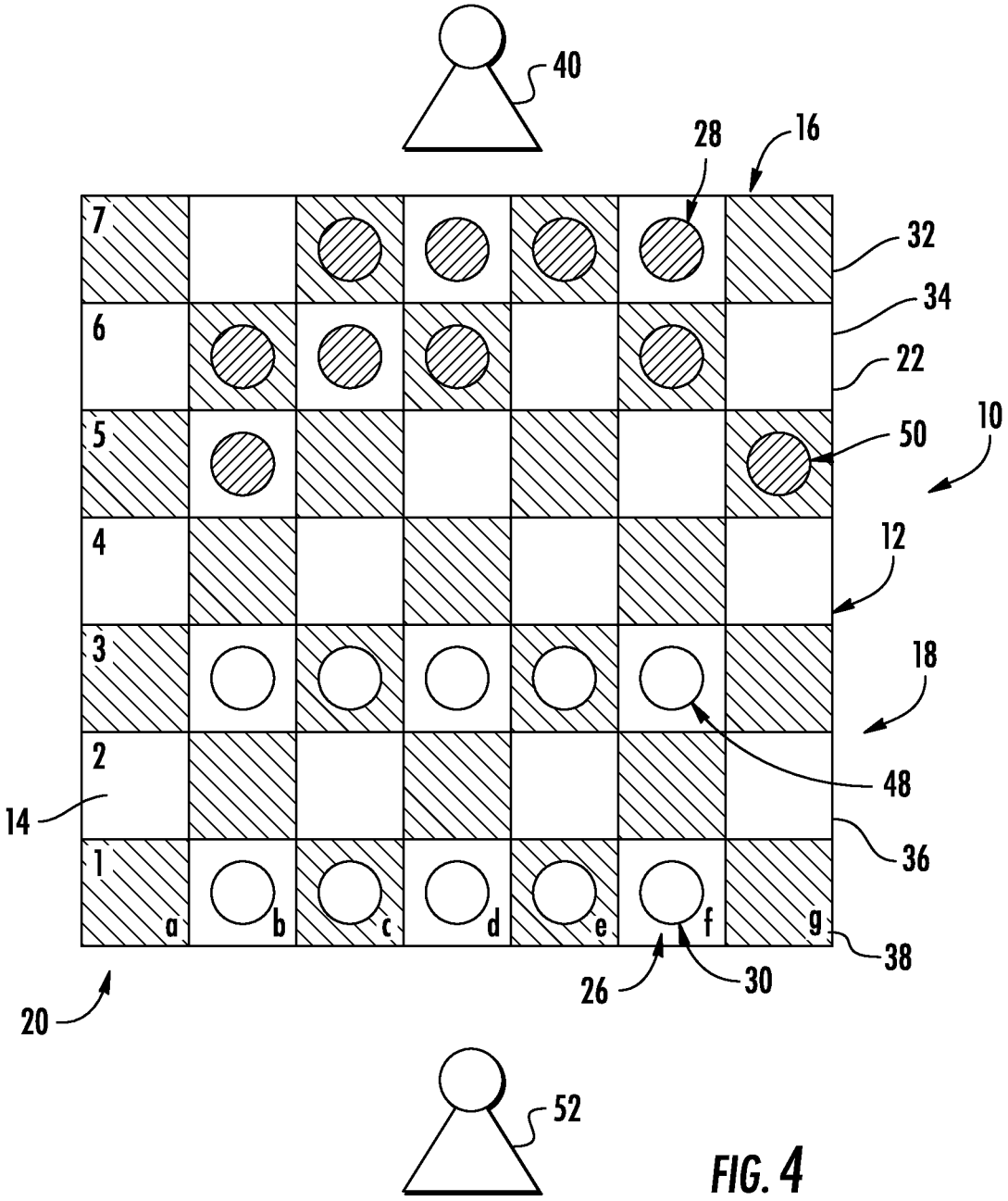
FIG. 4 illustrates the board game of FIG. 3, with player tokens in a resulting position after a second player's turn in accordance with one embodiment.

In a manner similar to that described above, the second player (52) moves (54) one or more of the second player tokens (30) up to five playing spaces (14), allocating the five movements across any combination of the second player tokens (30). As shown in FIG. 4, the second player (52) may move (54) each of five different second player tokens (30) one playing space (14) each. The players (40 and 52) then determine if the second player's movements result (56) in at least three of the second player tokens (30) being orthogonal to a first player token (28). If, as shown in FIG. 4, the second player's movements do not result (56) in at least three of the second player tokens (30), being on playing spaces (14) orthogonal to a playing space (14) occupied by a first player token (28), play moves back to the first player (40), who then moves (42) again.

Figure 6:
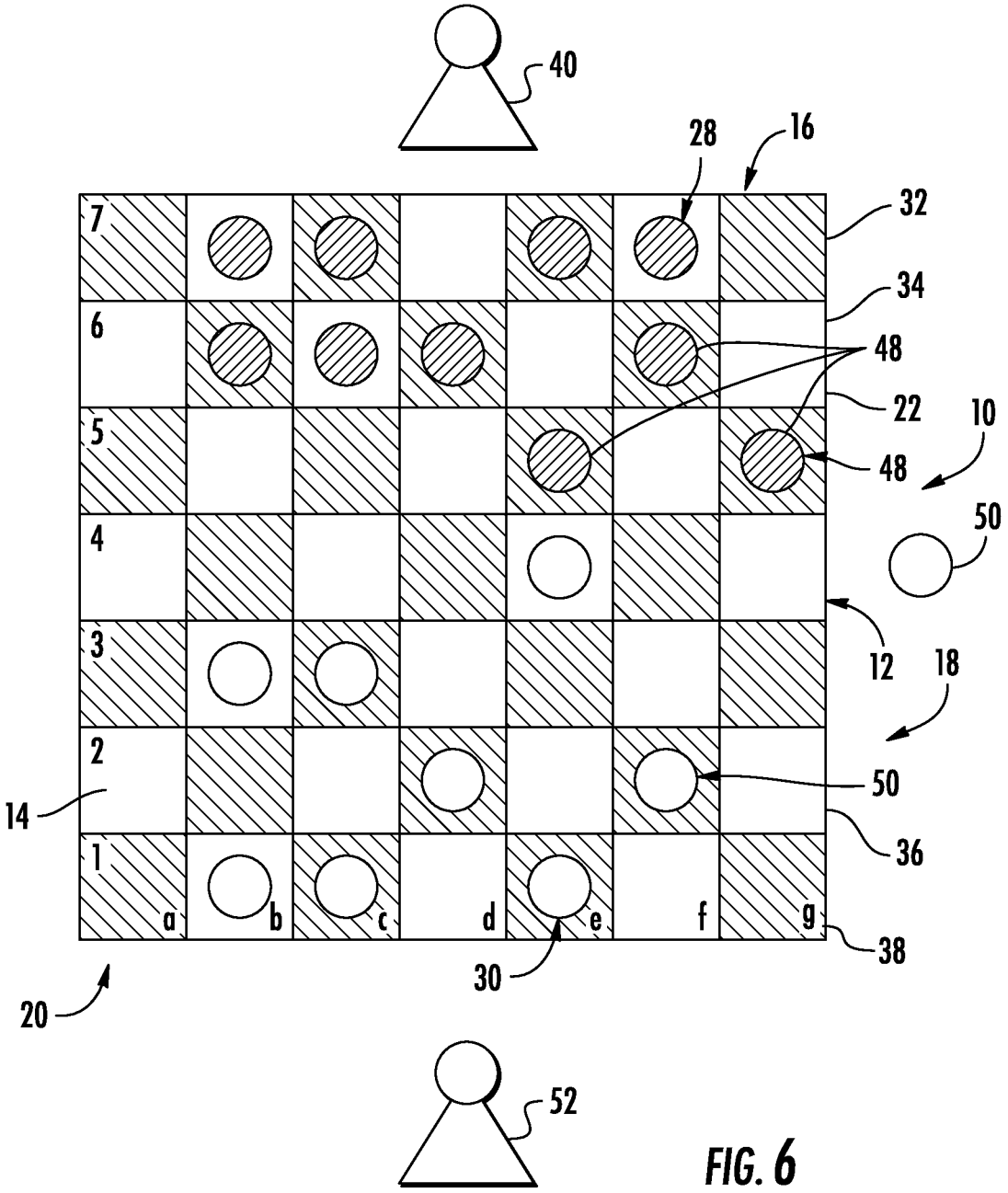
FIG. 6 illustrates the board game of FIG. 5, with the second player's player token being removed from the play area player after being surrounded on three sides by the first player's player tokens the in accordance with one embodiment.

Players (40 and 52) continue to alternate subsequent turns until a turn occurs where one player's movements result in at least three of that player's attacking tokens (48) being located on playing spaces (14) orthogonal to a playing space (14) occupied by a defending token (50). As shown in FIG. 5, the first player's turn results (46) in three of the first player's attacking tokens (48) being in playing spaces (14) orthogonal to a second player's defending token (50). In this case, the defending token (50) is removed (58) from the grid (16) and eliminated from play. The players (40 and 52) then determine (60) if the removal of the defending token (50) results in the second player (52) being left with a predetermined number of player tokens (26). While this predetermined number may be any desired number, in a preferred embodiment the predetermined number is two, since this is fewer than the minimum number of player tokens (26) a player needs to capture an opposing player's token. If, as shown in FIG. 6, the removal of the defending token (50) does not result in the second player (52) being left with only two player tokens (26), play moves to the second player (52), and the second player (52) again moves (54) one or more of the second player tokens (30) up to five playing spaces (14).

Figure 7:
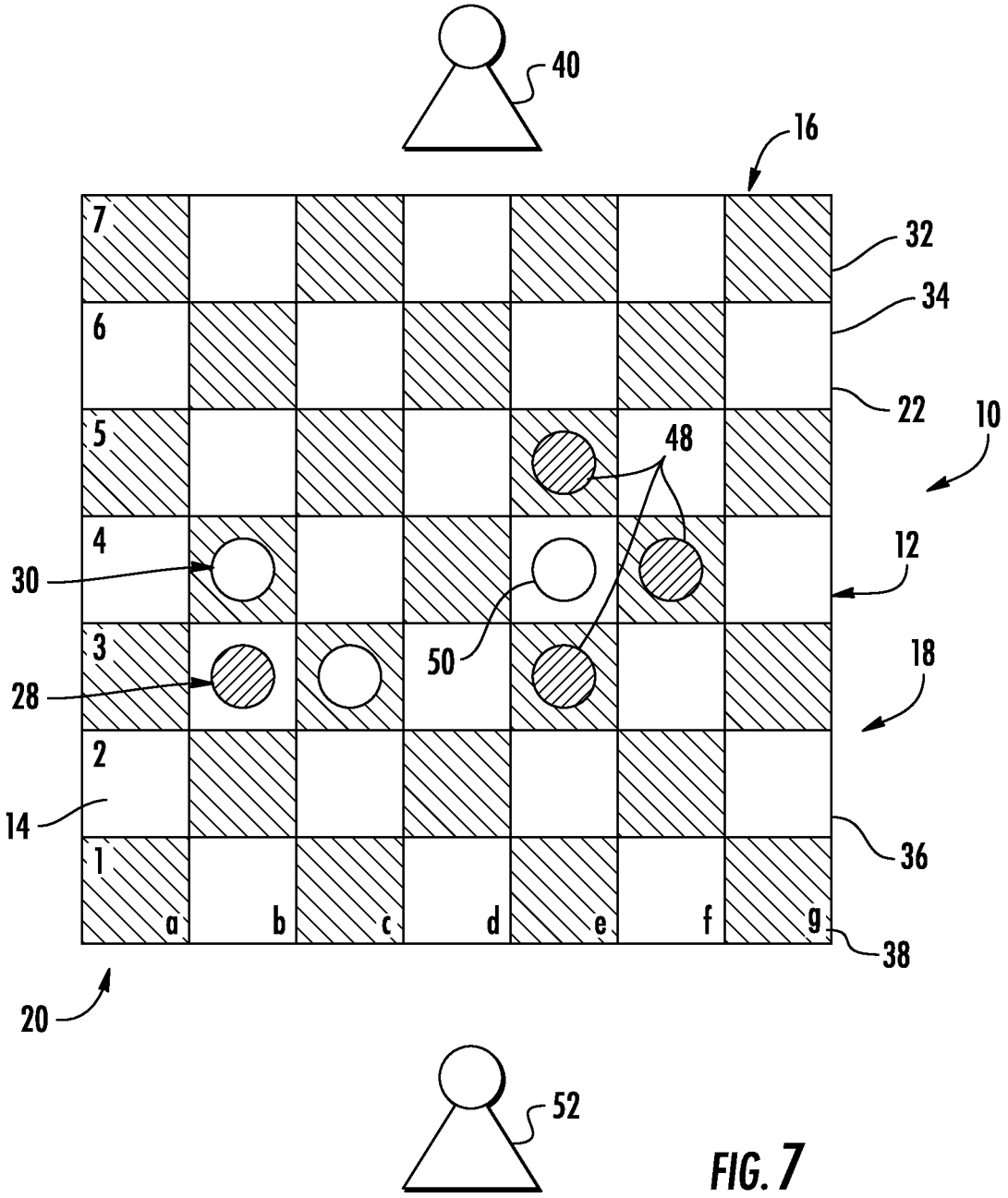
FIG. 7 illustrates the board game of FIG. 6, with the second player's seventh player token being surrounded on three sides by the first player's player tokens, triggering the winning condition for the first player in accordance with one embodiment.

Players (40 and 52) continue to alternate subsequent turns until a turn occurs where, as shown in FIG. 7, one player's movements result in at least three of that player's attacking tokens (48) being located on playing spaces (14) orthogonal to a playing space (14) occupied by a defending token (50), and that defending token (50) is one of the last three of that player's tokens. As shown in FIG. 7, if the first player's turn results (46) in three of the first player's attacking tokens (48) being in playing spaces (14) orthogonal to a second player's defending token (50), and the defending token is one of the last three second player tokens (30) remaining on the grid (16), the game is concluded (62), with the first player (40) being declared the winner.

Similarly, if one of the second player's turn results (56) in three of the second player's attacking tokens (48) being in playing spaces (14) orthogonal to a first player's defending token (50), the defending token (50) is removed (64) from the grid (16). If the second player's turn results (66) in the removed defending token being one of the last three first player tokens (28) remaining on the grid (16), the game is concluded (68), with the second player (52) being declared the winner.

Figure 8:
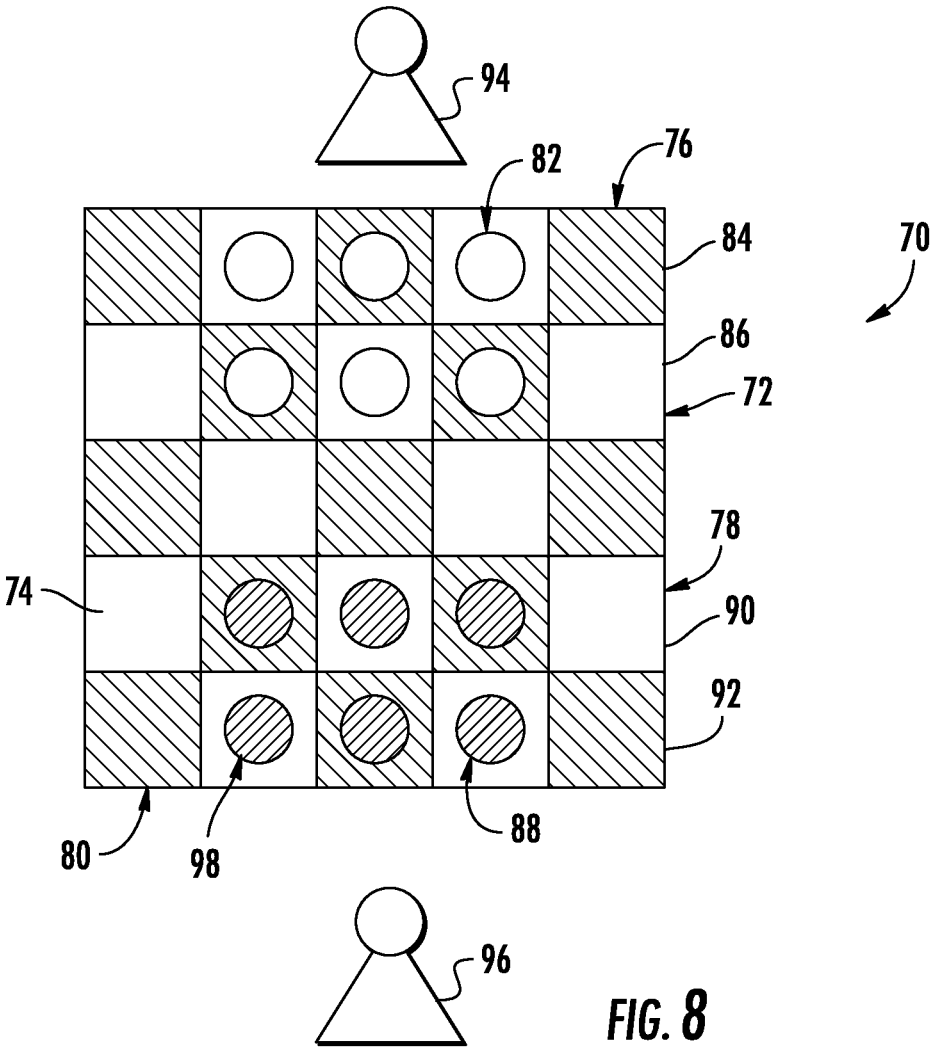
FIG. 8 illustrates an alternative embodiment of a board game having a game board with a smaller play area and fewer player tokens in accordance with one embodiment.

An alternative embodiment of the present invention is shown generally as (70) in FIG. 8. In this embodiment, the board game (70) has a gridded playing board (72) having a twenty-five playing spaces (74) arranged on a grid (76) of five rows (78) and five columns (80). Three first player tokens (82) are centered on the first row (84) of the grid (76) and three first player tokens (82) are centered on the second row (86) of the grid (76). Similarly, three second player tokens (88) are centered on the fourth row (90) of the grid (76) and five second player tokens (88) are centered on the fifth row (92) of the grid (76). Play alternates between a first player (94) and a second player (96) in a manner similar to that described above until one player is left with only two player tokens (98), and the opposing player is declared the winner.

Figure 9:
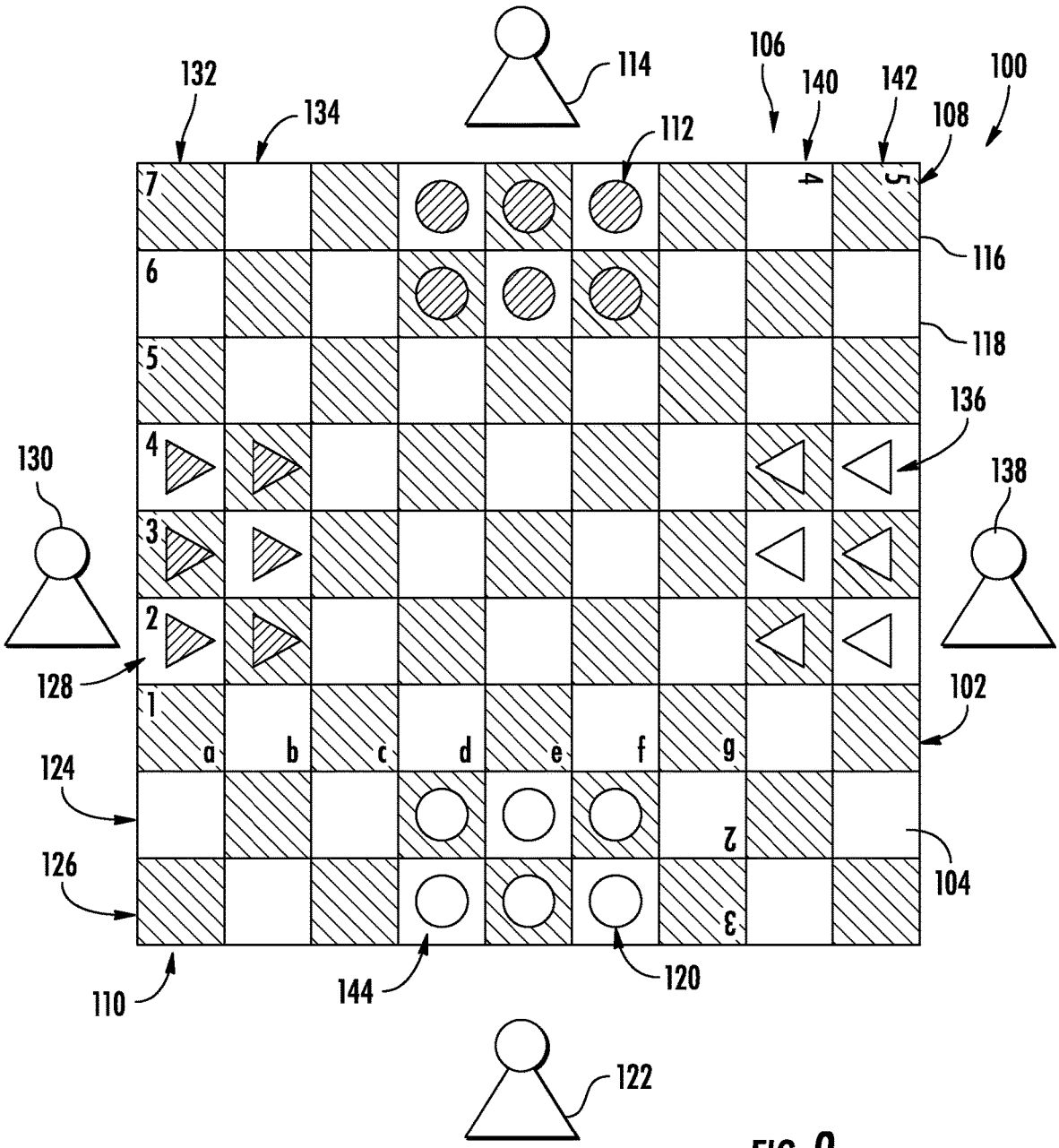
FIG. 9 illustrates an alternative embodiment of a board game having a game board with a larger play area for four player's with player tokens in a starting position in accordance with one embodiment.
Figure 10:
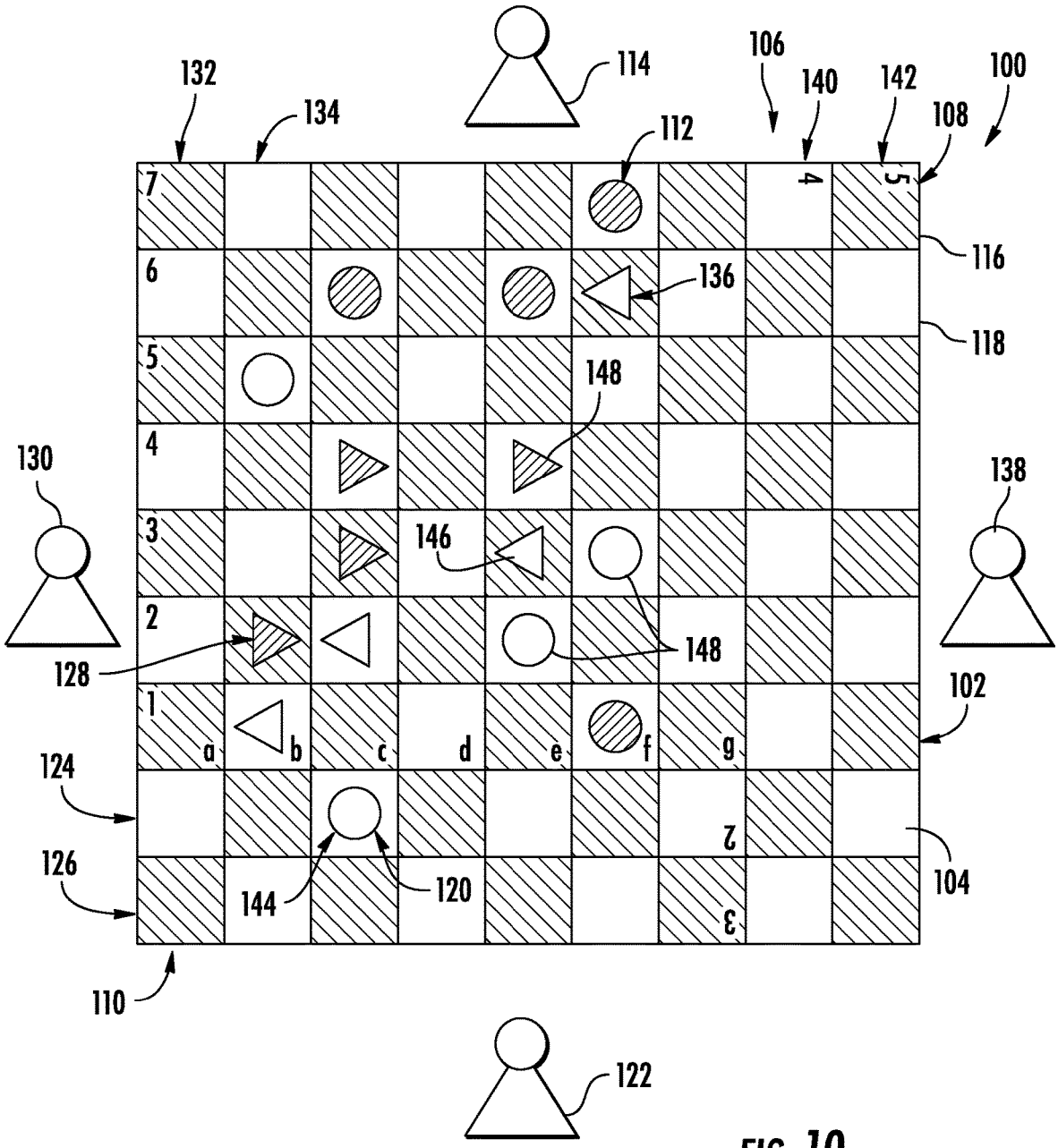
FIG. 10 illustrates the board game of FIG. 9, after multiple turns, with player tokens in a resulting position after a first player's and second player's player tokens have surrounded a third player's player token on three sides in accordance with one embodiment.

Another alternative embodiment of the present invention is shown generally as (100) in FIGS. 9-10. In this embodiment, the board game (100) has a gridded playing board (102) having eighty-one playing spaces (104) arranged on a grid (106) of nine rows (108) and nine columns (110). Three first player tokens (112) associated with at first player (114) are centered on the first row (116) of the grid (106) and three first player tokens (112) are centered on the second row (118) of the grid (106). Similarly, three second player tokens (120) associated with a second player (122) are centered on the eighth row (124) of the grid (106) and three second player tokens (120) are centered on the ninth row (126) of the grid (106). Three third player tokens (128) associated with a third player (130) are centered on the first column (132) of the grid (106) and three third player tokens (128) are centered on the second column (134) of the grid (106). Three fourth player tokens (136) associated with a fourth player (138) are centered on the eighth column (140) of the grid (106) and three fourth player tokens (136) are centered on the ninth column (142) of the grid (106). Play moves from the first player (114), to the second player (122), to the third player (130), to the fourth player (138), and back to the first player (114) in a manner similar to that described above until one player is left with only two player tokens (144), at which point that player's remaining two tokens are removed from the board. Play continues until only one player remains and that player is declared the winner. As shown in FIG. 10, in a game with three or more players, a defending token (146) may be removed even if the attacking tokens (148) are not all tokens associated with a single opposing player. As shown in FIG. 10, a defending token (146) may be removed if two of the attacking tokens (148) belong to one opposing player and one of the attacking tokens (148) belongs to another opposing player. Similarly, a defending token (146) may be removed if all three of the attacking tokens (148) belong three different opposing players.

Although the invention has been described with respect to a preferred embodiment thereof, it is to be understood that it is not to be so limited since changes and modifications can be made therein which are within the full, intended scope of this invention as defined by the appended claims.

What is claimed is:

1. A method of playing a board game comprising:

providing (i) a playing board defining a play area having a seven by seven grid of playing spaces, (ii) ten first player tokens associated with a first player, and (iii) ten second player tokens associated with a second player;

wherein the game initiates with five of the first player tokens provided on a first starting row of five of the playing spaces located along an edge of the grid, wherein there remains an empty playing space on each side of the first starting row, and wherein five of the first player tokens are provided on a second starting row of five of the playing spaces located edge adjacent to the first starting row, wherein there remains an empty playing space on each side of the second starting row;

wherein the game initiates with five of the second player tokens provided on a third starting row of five of the playing spaces located along an edge of the grid opposite the edge of the grid along which the five first player tokens are provided, wherein there remains an empty playing space on each side of the third starting row, and wherein five of the second player tokens are provided on a fourth starting row of five of the playing spaces located edge adjacent to the third starting row, wherein there remains an empty playing space on each side of the fourth starting row;

taking a first player turn comprising a total of at least five orthogonal movements from one playing space to another edge-adjacent playing space, allocated across one or more of the first player tokens, wherein the first player turn is completed without movement of the second player tokens, wherein for the duration of the first player turn, the first player tokens are defined as attacking tokens and the second player tokens are defined as defending tokens;

subsequent to the first player turn, taking a second player turn comprising a total of at least five orthogonal movements from one playing space to another edge-adjacent playing space, allocated across one or more of the second player tokens, wherein the second player turn is completed without movement of the first player tokens, wherein for the duration of the second player turn, the second player tokens are defined as attacking tokens and the first player tokens are defined as defending tokens;

subsequent to the second player turn, the first player and the second player alternating subsequent player turns until a turn occurs where one of the defending tokens is orthogonally surrounded by exactly three of the attacking tokens, wherein the attacking tokens are located on such turn on exactly three different playing spaces orthogonally edge-adjacent to a playing space occupied by the defending token;

wherein the orthogonally surrounded defending token is removed from the grid as a result of the attacking tokens being located on the exactly three different playing spaces orthogonally edge-adjacent to the playing space containing the orthogonally surrounded defending token and wherein one playing space orthogonally edge-adjacent to the playing space containing the orthogonally surrounded defending token does not contain an attacking token;

wherein one of the defending tokens is retained on the grid as a result of only two of the attacking tokens being located on only two different spaces orthogonally edge-adjacent, and on opposite sides of, the playing space containing the defending token;

wherein the first player and the second player alternate subsequent turns;

wherein the game is concluded when the number of tokens remaining on the grid associated with one of the players is reduced to a predetermined number of tokens and the other player is determined to be the winner.

2. The method of playing a board game of claim 1, wherein the predetermined number of tokens is two.

* * * * *